US011666186B2

(12) United States Patent
Grindley

(10) Patent No.: US 11,666,186 B2
(45) Date of Patent: Jun. 6, 2023

(54) STORAGE AND DISPENSING DEVICE FOR STANDARD AND INDUSTRIAL SIZE TOILET PAPER ROLLS

(71) Applicants: Bethune Grindley, Burke, VA (US); Happy Ingenuity Solutions LLC, Burke, VA (US)

(72) Inventor: Bethune Grindley, Burke, VA (US)

(73) Assignee: HAPPY INGENUITY SOLUTIONS LLC, Burke, VA (US)

( * ) Notice: Subject to any disclaimer, the term of this patent is extended or adjusted under 35 U.S.C. 154(b) by 220 days.

(21) Appl. No.: 17/062,542

(22) Filed: Oct. 2, 2020

(65) Prior Publication Data

US 2021/0100409 A1 Apr. 8, 2021

Related U.S. Application Data

(60) Provisional application No. 63/054,047, filed on Jul. 20, 2020, provisional application No. 62/909,610, filed on Oct. 2, 2019.

(51) Int. Cl.

| | |
|---|---|
| ***A47K 10/36*** | (2006.01) |
| ***A47K 10/40*** | (2006.01) |
| ***A47K 10/38*** | (2006.01) |

(52) U.S. Cl.

CPC ..... *A47K 10/3687* (2013.01); *A47K 10/3836* (2013.01); *A47K 10/405* (2013.01)

(58) Field of Classification Search

None

See application file for complete search history.

(56) References Cited

U.S. PATENT DOCUMENTS

| | | | | | |
|---|---|---|---|---|---|
| 1,656,464 | A * | 1/1928 | Auren | D04B 3/06 | 242/594 |
| 1,929,160 | A * | 10/1933 | Bellocchio | B65H 16/021 | 242/594.3 |
| 2,861,751 | A * | 11/1958 | Sarro | A47K 10/38 | 242/597 |
| 3,228,618 | A * | 1/1966 | Bracken | A47K 10/3836 | 242/597.5 |
| D237,459 | S * | 11/1975 | Wagner, Sr. | 242/603 | |
| 4,595,153 | A * | 6/1986 | Goetz | A47K 10/3836 | 242/597 |
| 2006/0231438 | A1* | 10/2006 | Anderson | A47K 10/22 | 206/394 |

(Continued)

*Primary Examiner* — William A. Rivera

(57) ABSTRACT

A storage and dispensing device for standard and industrial size toilet paper rolls has a mounting member, a base member, a roll storage member, and a mounting element. The mounting element is positioned on the mounting member, and utilizes an over-the-door hook or one or more apertures to hang the mounting member from a door or wall. The base member is connected to the bottom of the mounting member. The roll storage member is connected to the base member opposite the mounting member and is angled upwards to accept multiple rolls of toilet paper. An industrial sized toilet paper roll may be accommodated by the base member. The mounting member may be adjustable in length. An upper roll storage member may be connected to the mounting member opposite the base member for additional roll storage. A locking member between the roll storage member and the mounting member may prevent theft.

16 Claims, 5 Drawing Sheets

(56) References Cited

U.S. PATENT DOCUMENTS

| | | | | |
|---|---|---|---|---|
| 2007/0215742 | A1* | 9/2007 | Zollinger | B65H 49/16 242/594.6 |
| 2012/0234963 | A1* | 9/2012 | Channel | A47K 10/38 242/560.2 |
| 2016/0270607 | A1* | 9/2016 | Zeng | A47K 10/3836 |
| 2017/0319019 | A1* | 11/2017 | Simmons | A47K 10/3836 |
| 2020/0046176 | A1* | 2/2020 | Haralovich | A47K 10/22 |

* cited by examiner

STORAGE AND DISPENSING DEVICE FOR STANDARD AND INDUSTRIAL SIZE TOILET PAPER ROLLS

The current application claims a priority to the U.S. Provisional Patent application Ser. No. 62/909,610 filed on Oct. 2, 2019. The current application also claims a priority to the U.S. Provisional Patent application Ser. No. 63/054,047 filed on Jul. 20, 2020.

FIELD OF THE INVENTION

The present invention relates generally to bathroom storage. More specifically, the present invention relates to a toilet paper holder that can store multiple toilet paper rolls on a bathroom door or wall.

BACKGROUND OF THE INVENTION

Presently, there is demand for a toilet paper storage device, particularly for restrooms without adequate existing storage solutions for toilet paper rolls. A toilet paper holder is commonly mounted to a wall near the toilet. The installation of such wall-mounted toilet paper holders requires mechanical fasteners and anchoring devices.

In some cases, installation may require cutting an opening in the wall. Moreover, in some places, some restrooms may be too small to store or install wall-mounted holders. Therefore, there is a need to provide a toilet paper holder or storage device that can be secured onto the door or a wall of smaller restrooms to provide a readily accessible toilet paper roll storage.

The present invention aims to solve the problems associated with conventional toilet paper holding devices through a unique construction of a toilet paper storage device that can store multiple standard toilet paper rolls in restrooms with limited space, in addition to enabling storage and dispensing of an industrial sized toilet paper roll.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a combination toilet paper dispenser and storage device suitable for any types of bathroom, but works particularly well for bathrooms/restrooms with limited space and for any restroom which needs to store and dispense an industrial type and sized roll of toilet paper. The present invention can be used in any location with a door in some embodiments, or with a hook, nail, or screw attached to a wall in some embodiments. The present invention may, in various embodiment, be either simultaneously or asynchronously be configured to store and dispense both or either standard toilet paper rolls and industrial size toilet paper rolls according to the particular needs, such as supply and demand, of a user, establishment or other entity.

Figure 1:
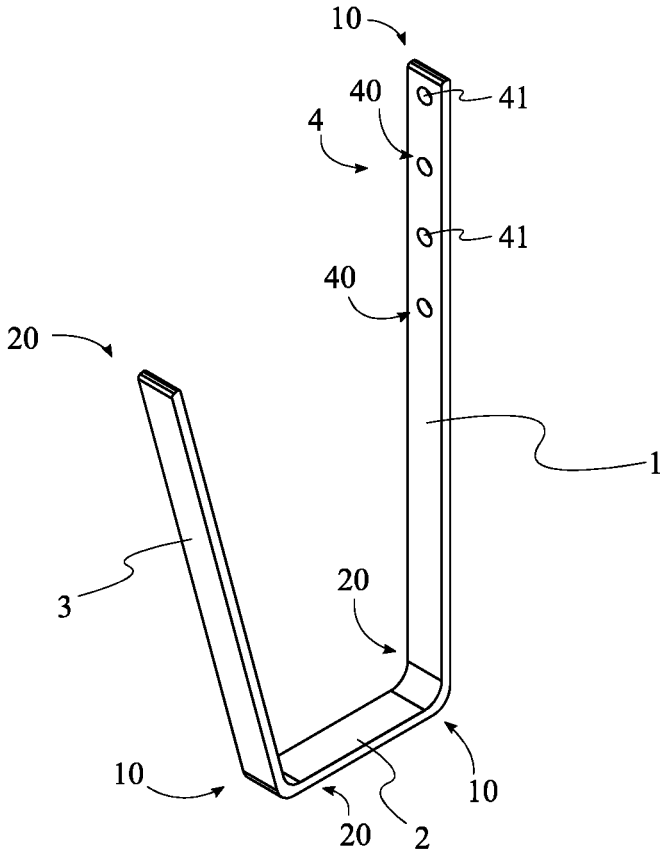
FIG. 1 is a perspective view of one embodiment of the present invention with a plurality of apertures as the mounting element.
Figure 2:
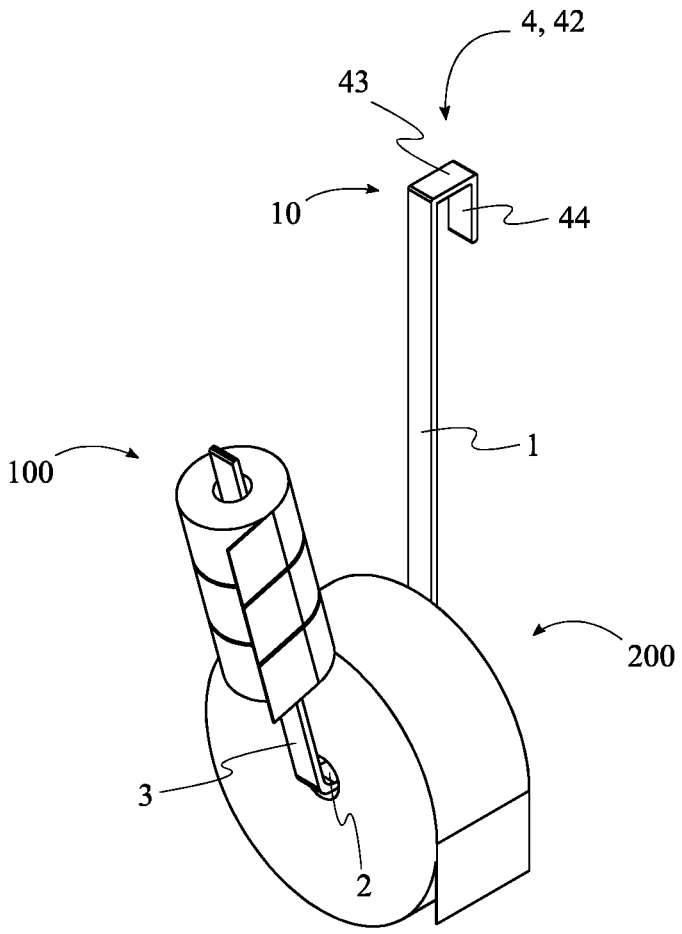
FIG. 2 is a perspective view of one embodiment of the present invention with an over-the-door hook as the mounting element and showing toilet paper rolls being stored.

In general, referring to FIGS. 1-2, the present invention comprises a mounting member 1, a base member 2, a roll storage member 3, and a mounting element 4. The mounting element 4 is positioned on the mounting member 1, wherein the mounting element 4 is configured to mount the mounting member 1 adjacent to a vertical surface such as a wall or a door. The base member 2 is terminally connected to the mounting member 1, and the roll storage member 3 is terminally connected to the base member 2 opposite the mounting member 1 along the base member 2, wherein the roll storage member 3 is configured to receive and support a plurality of toilet paper rolls 100.

It should be generally understood that the mounting member 1, the base member 2, and the roll storage member 3 may be formed according to any geometry and dimensions that are suitable for facilitating the spirit and scope of the present invention as herein described. However, in the preferred embodiment of the present invention, the mounting member 1, the base member 2, and the roll storage member 3 generally have elongated, flat geometry. In some embodiments, the mounting member 1, the base member 2, and the roll storage member 3 are formed from a continuous length of material and distinguished only by the bends, angles, or other junctions between the said members, though this is not necessarily a requirement, and in some embodiments the said members may be constructed as separate pieces and joined together through various attachment means. In some embodiments, the mounting member 1, the base member 2, and the roll storage member 3 are constructed from punched metal plate material. It is further noted that the various components of the present invention may be constructed of any suitable material, such as, but not limited to, various types of steel, plastic, wood, stone, or other materials.

The mounting element 4 may vary in different embodiments, as will be further disclosed hereinafter. The mounting element 4 serves to mount the present invention to a door or wall, and the mounting member 1 serves to couple the mounting element 4 with the remainder of the present invention. Generally, the roll storage member 3 is an elongated member onto which standard size toilet paper rolls 100 may be placed for storage. The inner cardboard tube, or otherwise, the central internal space of one or more toilet paper rolls 100 is placed over the free end of the roll storage member 3, which can hold around three to five or more toilet paper rolls 100, depending on the length of the roll storage member 3.

The base member 2 connects the mounting member 1 to the roll storage member 3, and together the three said member generally form a flat-bottomed U shape in the preferred embodiment of the present invention, though the specific geometry of the said members may vary in different embodiments. Moreover, in the preferred embodiment, the base member 2 is configured to receive and support at least one industrial sized toilet paper roll 200, such that the industrial sized toilet paper roll 200 or rolls encircle the base member 2 when the industrial sized toilet paper roll 200 is supported by the base member 2. In general, in order to situation an industrial sized toilet paper roll 200 onto the base member 2, a central opening of the industrial sized toilet paper roll 200 is maneuvered onto the free end of the roll storage member 3, across the length of the roll storage member 3, and subsequently onto the base member 2, as the roll storage member 3 and the base member 2 are generally part of a continuous structure as previously mentioned.

The mounting member 1, the base member 2, and the roll storage member 3 each comprise a first end 10 and a second end 20. The mounting member 1 extends between the first end 10 and the second end 20 of the mounting member 1, the base member 2 extends between the first end 10 and the second end 20 of the base member 2, and the roll storage member 3 extends between the first end 10 and the second end 20 of the roll storage member 3. The first end 10 of the base member 2 is connected to the second end 20 of the mounting member 1, and the first end 10 of the roll storage member 3 is connected to the second end 20 of the base member 2. To situate an industrial sized toilet paper roll 200 on the base member 2, a user may slide the industrial sized toilet paper roll 200 over the second end 20 of the roll storage member 3, toward the first end 10 of the roll storage member 3, and over the second end 20 of the base member 2, to be situated between the first end 10 and the second end 20 of the base member 2.

Figure 3:
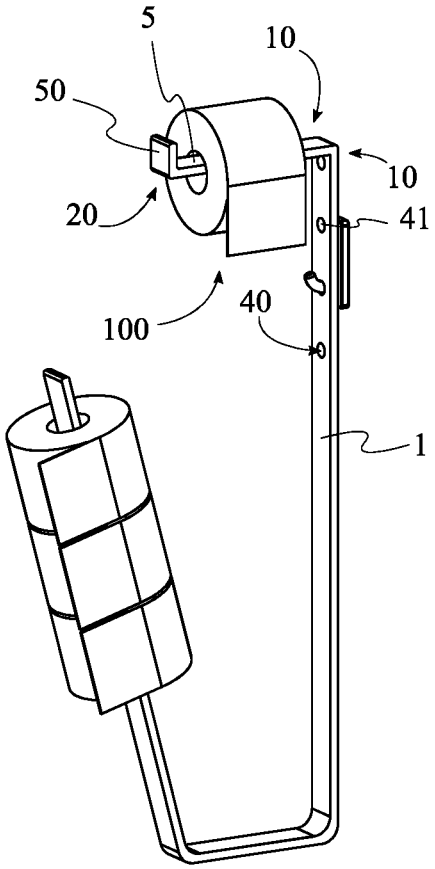
FIG. 3 is a perspective view of one embodiment of the present invention with an upper roll storage member and showing toilet paper rolls being stored.

It is contemplated that the mounting element 4 may vary in different embodiments, and the present invention may incorporate any suitable means to install the present invention in a desired location in a bathroom. In some embodiments, as shown in FIG. 1, the mounting element 4 comprises at least one aperture 40, each of the at least one aperture 40 traversing through the mounting member 1. In such embodiments, the at least one aperture 40 may be placed over a hook, nail, screw, or other such protrusion affixed into a wall or door, thus hanging the present invention from the wall or door. FIG. 3 illustrates the use of a wall-mounted hook to hang the present invention. In some embodiments, the mounting element 4 may comprise a plurality of apertures 41, the plurality of apertures 41 traversing through the mounting member 1 and being distributed along the mounting member 1 between the first end 10 and the second end 20 of the mounting member 1. This arrangement affords a user the capacity to adjust the height at which the present invention is installed on a wall or door.

In some embodiments, as shown in FIG. 2, the mounting element 4 comprises an over-the-door hook 42 so that the present invention can be hung from the top of a door. In some embodiments, the over-the-door hook 42 is terminally connected to a first end 10 of the mounting member 1 opposite the base member 2 along the mounting member 1; thus, the over-the-door hook 42 is generally positioned at the top of the present invention, though the location of the over-the-door hook 42 may vary in alternative embodiments, if desired.

More specifically, the over-the-door hook 42 comprises a medial member 43 and a distal member 44. The medial member 43 is terminally and perpendicularly connected to the first end 10 of the base member 2, and the distal member 44 is terminally and perpendicularly connected to the medial member 43 opposite the mounting member 1 along the medial member 43. The medial member 43 and the base member 2 are positioned longitudinally opposite each other on the mounting member 1, such that the mounting member 1 is positioned longitudinally between the base member 2 and the over-the-door hook 42. This allows the over-the-door hook 42 to be installed atop a door, while the base member 2 and the roll storage member 3 extend outward from the door's surface.

In some embodiments, referring to FIG. 3, the present invention may further comprise an upper roll storage member 5 comprising a first end 10 and a second end 20, wherein the upper roll storage member 5 extends between the first end 10 and the second end 20 of the upper roll storage member 5. The upper roll storage member 5 provides an additional location for storage of toilet paper rolls 100. Moreover, in such embodiments, the present invention further comprises a roll retaining member 50. Preferably, the first end 10 of the upper roll storage member 5 is connected adjacent to the first end 10 of the mounting member 1, though this is not a strict requirement, and the upper roll storage member 5 may be positioned at any desired and suitable height along the mounting member 1. The roll retaining member is terminally and perpendicularly connected to the second end 20 of the upper storage member, providing a small barrier to keep any toilet paper rolls 100 from accidentally falling off the upper roll storage member 5.

Figure 4:
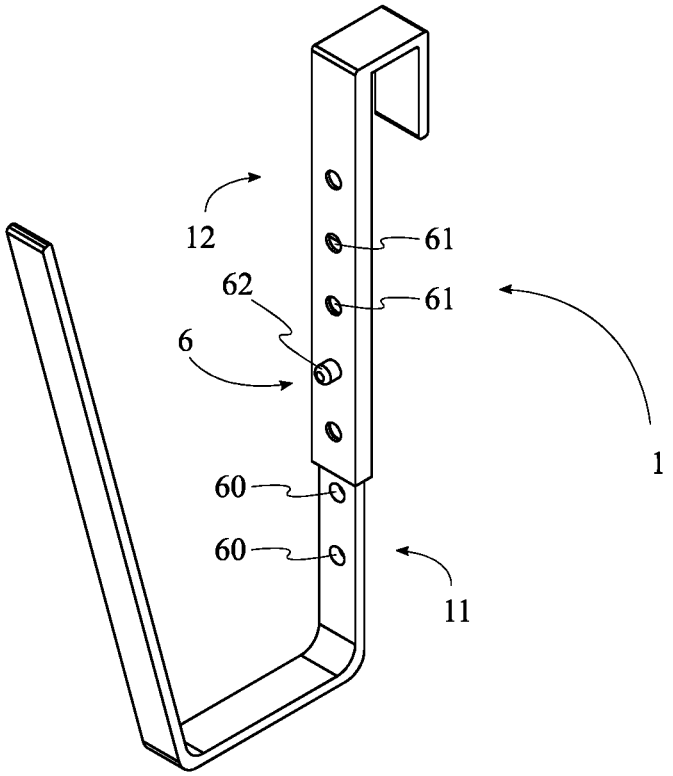
FIG. 4 is a perspective view of one embodiment of the present invention wherein the mounting member is telescopically adjustable.

In some embodiments of the present invention, the mounting member 1 is adjustable in length between the first end 10 and the second end 20 of the mounting member 1. To this end, as shown in FIG. 4, the mounting member 1 comprises, at least, a first mounting portion 11 and a second mounting portion 12. The first mounting portion 11 and the second mounting portion 12 are preferably oriented parallel to each other, and are adjustably engaged with each other, such that the overall length of the mounting member 1 between the first end 10 and the second end 20 of the mounting member 1 is adjusted by adjusting the amount of overlap between the first mounting portion 11 and the second mounting portion 12.

Further, the present invention may comprise a mount locking mechanism 6 to affix the first mounting portion 11 and the second mounting portion 12 together at a desired length. Further, in some embodiments, the first mounting portion 11 and the second mounting portion 12 may be telescopically engaged with each other, with the first mounting portion 11 and the second mounting portion 12 being releasably attached to each other through the mount locking mechanism 6.

It should be understood that the specific nature of the length adjustability and the mount locking mechanism 6 may vary in different embodiments, and may utilize any desired configuration that facilitates the spirit and scope of the present invention as herein described. In some embodiments, the mount locking mechanism 6 comprised a first plurality of apertures 60, a second plurality of apertures 61, and a pin 62. The first plurality of apertures 60 traverses through and is distributed along the first mounting portion 11, while the second plurality of apertures 61 traverses through and is distributed along the second mounting portion 12. The pin 62 is removably positioned within one of the first plurality of apertures 60 and one of the second plurality of apertures 61 in order to engage the mount locking mechanism 6.

Figure 5:
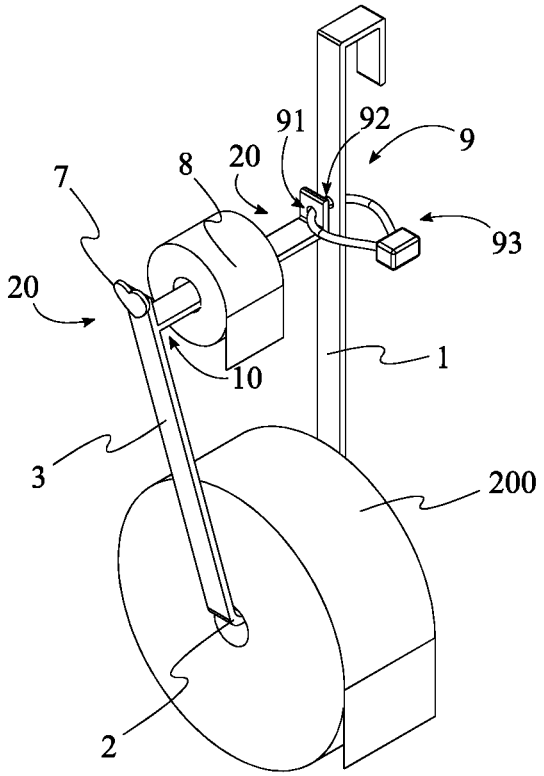
FIG. 5 is a perspective view of one embodiment of the present invention with a locking member and a decorative embellishment.

In some embodiments, as shown in FIG. 5, the present invention may further comprise a locking member 8, the locking member 8 comprising a first end 10 and a second end 20 and traversing between the first end 10 and the second end 20 of the locking mechanism. Further, in some embodiments, a roll locking mechanism 9 may be comprised. As such, the locking member 8 is releasably positioned between the second end 20 of the roll storage member 3 and the mounting member 1 through the roll locking mechanism 9. In some embodiments, the locking member 8 is oriented parallel to the base member 2.

The locking member 8 may serve multiple functions. Firstly, the locking member 8 may serve as a security measure to prevent theft of an industrial sized toilet paper roll 200 supported by the base member 2. To this end, the locking member 8 should be positioned at a vertical distance from the base member 2 greater than the radius of the industrial sized toilet paper roll 200. It is not unknown for persons using a public restroom, particularly one located in a small business, and particularly during a period of social unrest or uncertainty, such as a pandemic, to commit theft of toilet paper rolls due to real or perceived scarcity of toilet paper. Therefore, the locking member 8 provides a measure of security against such theft.

Preferably, the first end 10 of the locking member 8 is connected to the second end 20 of the roll storage member 3, while the second end 20 of the locking member 8 is releasably attached to the mounting member 1 through the roll locking mechanism 9. It may not be of particular importance which end of the locking member 8, if any, is affixed in place, hingedly or otherwise, so long as both ends of the locking member 8 are able to be securely fastened between the roll storage member 3 and the mounting member 1 in order to trap an industrial sized toilet paper roll 200 between the base member 2 and the locking member 8. Various locking mechanisms and means may be implemented in various embodiments to this end without departing from the spirit and scope of the present invention. In some embodiments, the roll locking mechanism 9 comprises a first aperture 91, a second aperture 92, and a lock 93. The first aperture 91 traverses through the locking member 8 adjacent to the second end 20 of the locking member 8, while the second aperture 92 traverses through the locking member 8 longitudinally opposite the roll storage member 3, wherein the base member 2 is oriented longitudinally. The lock 93 is therefore removably attached within the first aperture 91 and the second aperture 92. The lock 93 may be a simple padlock, cable lock, or another type of lock capable of affixing the first aperture 91 and the second aperture 92 together. However, it is contemplated, as previously noted, that any suitable means to releasably affix the locking member 8 in place between the roll storage member 3 and the mounting member 1 may be realized in various embodiments as desired.

Moreover, the locking member 8 may further be utilized to store and dispense a standard roll of toilet paper 100 in various embodiments.

Finally, in some embodiments, the present invention may further comprise a decorative embellishment 7 connected to the second end 20 of the roll storage member 3. The decorative embellishment 7 may be any desired shape, size, or have any other desired visual features to enhance the aesthetic appeal of the present invention.

Although the invention has been explained in relation to its preferred embodiment, it is to be understood that many other possible modifications and variations can be made without departing from the spirit and scope of the invention as hereinafter claimed.

What is claimed is:

1. A storage and dispensing device for toilet paper rolls of two distinct sizes comprising:

a mounting member;

a base member;

a roll storage member;

a mounting element;

the mounting element being positioned on the mounting member, wherein the mounting element is configured to mount the mounting member adjacent to a vertical surface;

the base member being terminally connected to the mounting member;

the roll storage member being terminally connected to the base member opposite the mounting member along the base member, wherein the roll storage member is configured to receive and support a plurality of toilet paper rolls; and wherein the mounting member is adjustable in length between a first end and a second end of the mounting member.

2. The storage and dispensing device for toilet paper rolls of two distinct sizes as claimed in claim 1 comprising:

the base member being configured to receive and support an industrial sized toilet paper roll, wherein the industrial sized toilet paper roll encircles the base member when the industrial sized toilet paper roll is supported by the base member.

3. The storage and dispensing device for toilet paper rolls of two distinct sizes as claimed in claim 1 comprising:

the mounting member, the roll storage member, and the base member each comprising a first end and a second end;

the mounting member extending between the first end and the second end of the mounting member;

the roll storage member extending between the first end and the second end of the roll storage member;

the base member extending between the first end and the second end of the base member;

the first end of the base member being connected to the second end of the mounting member; and the first end of the roll storage member being connected to the second end of the base member.

4. The storage and dispensing device for toilet paper rolls of two distinct sizes as claimed in claim 1 comprising:

the mounting element comprising at least one aperture; and each of the at least one aperture traversing through the mounting member.

5. The storage and dispensing device for toilet paper rolls of two distinct sizes as claimed in claim 1 comprising:

the mounting element comprising a plurality of apertures;

the plurality of apertures traversing through the mounting member; and the plurality of apertures being distributed along the mounting member between a first end and a second end of the mounting member.

6. The storage and dispensing device for toilet paper rolls of two distinct sizes as claimed in claim 1 comprising:

the mounting element comprising an over-the-door hook.

7. The storage and dispensing device for toilet paper rolls of two distinct sizes as claimed in claim 1 comprising:

the mounting element comprising an over-the-door hook; and the over-the-door hook being terminally connected to a first end of the mounting member opposite the base member along the mounting member.

8. The storage and dispensing device for toilet paper rolls of two distinct sizes as claimed in claim 7 comprising:

the over-the-door hook comprising a medial member and a distal member;

the medial member being terminally and perpendicularly connected to a first end of the base member; and the distal member being terminally and perpendicularly connected to the medial member opposite the mounting member along the medial member.

9. The storage and dispensing device for toilet paper rolls of two distinct sizes as claimed in claim 1 comprising:

an upper roll storage member comprising a first end and a second end;

the upper roll storage member extending between the first end and the second end of the upper roll storage member;

a roll retaining member;

the first end of the upper roll storage member being connected to a first end of the mounting member; and the roll retaining member being terminally and perpendicularly connected to the second end of the upper storage member.

10. The storage and dispensing device for toilet paper rolls of two distinct sizes as claimed in claim 1 comprising:

the mounting member comprising a first mounting portion and a second mounting portion;

the first mounting portion and the second mounting portion of the mounting member being oriented parallel to each other; and the first mounting portion and the second mounting portion of the mounting member being adjustably engaged with each other.

11. The storage and dispensing device for toilet paper rolls of two distinct sizes as claimed in claim 10 comprising:

a mount locking mechanism;

the first mounting portion and the second mounting portion being telescopically engaged with each other; and the first mounting portion and the second mounting portion being releasably attached to each other through the mount locking mechanism.

12. The storage and dispensing device for toilet paper rolls of two distinct sizes as claimed in claim 11 comprising:

the mount locking mechanism comprising a first plurality of apertures, a second plurality of apertures, and a pin;

the first plurality of apertures traversing through and being distributed along the first mounting portion;

the second plurality of apertures traversing through and being distributed along the second mounting portion; and the pin being removably positioned within one of the first plurality of apertures and one of the second plurality of apertures in order to engage the mount locking mechanism.

13. The storage and dispensing device for toilet paper rolls of two distinct sizes as claimed in claim 1 comprising:

a decorative embellishment; and the decorative embellishment being connected to a second end of the roll storage member.

14. The storage and dispensing device for toilet paper rolls of two distinct sizes as claimed in claim 1 comprising:

a locking member comprising a first end and a second end;

the locking member traversing between the first end and the second end of the locking member;

a roll locking mechanism; and the locking member being releasably positioned between a second end of the roll storage member and the mounting member through the roll locking mechanism.

15. The storage and dispensing device for toilet paper rolls of two distinct sizes as claimed in claim 14 comprising:

the first end of the locking member being connected to the second end of the roll storage member; and the second end of the locking member being releasably attached to the mounting member through the roll locking mechanism.

16. The storage and dispensing device for toilet paper rolls of two distinct sizes as claimed in claim 15 comprising:

the roll locking mechanism comprising a first aperture, a second aperture, and a lock;

the first aperture traversing through the locking member adjacent to the second end of the locking member;

the second aperture traversing through the locking member longitudinally opposite the roll storage member, wherein the base member is oriented longitudinally; and the lock being removably attached within the first aperture and the second aperture.

* * * * *